US005490635A

United States Patent [19]

Gray

[11] Patent Number: 5,490,635

[45] Date of Patent: Feb. 13, 1996

[54] CONTROL CAB SUPPORT MECHANISM

[75] Inventor: William R. Gray, New Berlin, Wis.

[73] Assignee: Astec Industries, Inc., Chattanooga, Tenn.

[21] Appl. No.: 252,937

[22] Filed: Jun. 2, 1994

[51] Int. Cl.[6] ..... B02C 9/04

[52] U.S. Cl. ..... 241/101.76; 180/327; 180/89.13

[58] Field of Search ..... 180/89.13, 89.14, 180/89.15, 311, 326, 327, 328; 241/101.75, 101.76; 280/781

[56] References Cited

U.S. PATENT DOCUMENTS

| | | | |
|---|---|---|---|
| 3,233,765 | 2/1966 | Barnes | 180/89.13 X |
| 3,804,345 | 4/1974 | DeDiemar | 241/264 |
| 3,948,341 | 4/1976 | Foster | 180/89.15 |
| 3,984,058 | 10/1976 | Archer et al. | 241/264 |
| 4,140,281 | 2/1979 | Fulghum, Jr. et al. | 241/101.76 X |
| 4,165,044 | 8/1979 | Batch | 241/264 |
| 4,546,849 | 10/1985 | Kelley et al. | 180/89.13 X |
| 4,783,013 | 11/1988 | Polzin | 241/264 |
| 4,951,885 | 8/1990 | Thüs | 241/101.75 X |
| 5,197,682 | 3/1993 | Del Zotto | 241/101.76 |

FOREIGN PATENT DOCUMENTS

| | | | |
|---|---|---|---|
| 2530605 | 1/1984 | France | 180/326 |
| 1217802 | 12/1964 | Germany | 180/89.13 |
| 2744972 | 4/1979 | Germany | 180/89.13 |
| 7900118 | 8/1979 | WIPO | 180/327 |

*Primary Examiner*—Timothy V. Eley
*Attorney, Agent, or Firm*—Nilles & Nilles

[57] ABSTRACT

A portable mineral processing machine has a chassis, a mineral processing device mounted on the chassis, and a control cab support mechanism operative to vertically raise the control cab from a lowered in pit transport position in which it is supported on the chassis to a raised operative position in which it is supported on the ground and elevated to a designated height above the chassis. The control cab support mechanism preferably comprises a scissor lift mechanism including upper and lower scissor mechanisms which are independently operated by respective upper and lower double-acting hydraulic cylinders or the like. The upper scissor mechanism is operative to raise an upper platform with respect to an intermediate support platform, and the lower scissor mechanism is operative to first lower a lower platform with respect to the intermediate support platform, and then to raise the intermediate support platform, upper scissor mechanism, and upper platform with respect to the lower platform.

21 Claims, 9 Drawing Sheets

CONTROL CAB SUPPORT MECHANISM

BACKGROUND OF THE INVENTION

1. Field of the Invention

The invention relates to portable mineral processing machines and, more particularly, relates to portable mineral processing machines having control cabs and to a method and apparatus for supporting and positioning the control cab of such a machine with respect to the remainder of the machine.

2. Discussion of the Related Art

Mineral processing machines including jaw crushers, gyrasphere crushers, vibrating feeders, and/or other components of portable aggregate plants must be portable so as to be capable of being transported between worksites in a quarry and thus are typically mounted on portable chassis. These machines are, however, typically relatively large and thus are difficult to transport to and from worksites within a quarry (usually referred to as in pit transport). Such transport is required relatively frequently, e.g. to move a plant away from the face of a pit to permit blasting and to subsequently reposition the plant near the face of the pit. In pit transport is further hindered because many such machines are accompanied by enclosed control cabs serving as a work stations for operators. Such control cabs have heretofore been either (1) permanently mounted on mineral processing machines, or (2) mounted on separate portable scaffolds which can be independently transported between worksites within a quarry and erected in a freestanding or dependent relationship to the mineral processing machines.

Control cabs which are permanently mounted on mineral processing machines necessarily increase the size and weight of the overall machines, thus hindering in pit transport. Moreover, many mineral processing machines such as jaw crushers are subject to rather severe vibrations in use, and these vibrations are imparted to the control cabs. Such vibrations may prove harmful to the controls mounted in or on the cabs as well as to the operators.

Independently transportable control cabs permit the size and weight of a mineral processing machine to be reduced during in pit transport but require the in pit transport of two separate elements per machine and thus increase transport expense. Such control cabs also require a relatively lengthy setup time since such a control cab must be positioned and erected at an appropriate location near or on a mineral processing machine independently of machine positioning. Even independently transported control cabs are also typically mounted on the associated mineral processing machine at the worksite, thus subjecting the cab and operator to vibrations as discussed above.

OBJECTS AND SUMMARY OF THE INVENTION

It is therefore an object of the invention to provide a control cab support mechanism for a mineral processing machine which facilitates in pit transport of the control cab and of the remainder of the machine and which in operation supports and positions the control cab so as to prevent vibrations of the mineral processing device on the machine from being imparted to the control cab.

Another object of the invention is to provide a control cab support mechanism of the type described above which can ensure optimum placement of the control cab with respect to the remainder of the mineral processing machine.

Yet another object of the invention is to provide a control cab support mechanism having one or more of the attributes discussed above and which is relatively simple, durable, and sturdy.

In accordance with a first aspect of the invention, a control cab assembly is provided for housing an operator for a mineral processing machine and includes a control cab and a control cab support mechanism on which the control cab is mounted. The control cab support mechanism is actuatable to raise the control cab from a first position in which the control cab is supported on the chassis to a second position in which the control cab is lifted above the chassis and supported on the ground.

Preferably, the control cab support mechanism includes an upper platform on which is mounted the control cab, a lower platform for engaging the ground, and a support platform which is positioned between the upper and lower platforms and which rests on the chassis when the control cab is in the first position. An upper scissor mechanism connects the upper platform to the support platform, and a lower scissor mechanism connects the lower platform to the support platform.

The upper and lower scissor mechanisms are preferably hydraulically actuated, in which case an upper cylinder connects the support platform to the upper scissor mechanism and a lower cylinder connects the support platform to the lower scissor mechanism.

Yet another object of the invention is to provide a mineral processing machine employing a control cab support mechanism having one or more of the characteristics discussed above.

In accordance with another aspect of the invention, this object is achieved by providing a mineral processing machine including a portable chassis, a mineral processing device mounted on the chassis, a control cab, and means for lifting the control cab from an in pit transport position in which the control cab is supported on the chassis to an operative position in which the control cab is (1) lifted from the chassis and (2) supported on the ground.

Preferably, a pair of support arms are attached to and extend transversely away from the chassis and form a support assembly which supports the control cab when the control cab is in its in pit transport position.

The means for lifting preferably comprises a scissor lift mechanism which includes an upper platform on which the control cab is mounted, a lower platform for engaging the ground, a support platform which rests on the support assembly when the control cab is in the transport position, an upper scissor mechanism connecting the upper platform to the support platform, and a lower scissor mechanism connecting the lower platform to the support platform.

Still another object of the invention is to provide a method of transporting a mineral processing machine including a control cab within a pit and of subsequently positioning the control cab with respect to the remainder of the mineral processing machine.

In accordance with yet another aspect of the invention, this object is achieved by a method including supporting a control cab on a support assembly of a chassis of a mineral processing machine, then transporting the mineral processing machine to a worksite within a pit, and then actuating a control cab support mechanism to lift the control cab from the support assembly, and then supporting the control cab on the ground independently of the chassis. Preferably, the supporting step comprises supporting the control cab on the ground via the control cab support mechanism and the lifting step comprises actuating a scissor lift mechanism which includes an upper platform on which is mounted the control cab, a lower platform, a support platform, an upper scissor mechanism connecting the upper platform to the support platform, and a lower scissor mechanism connecting the support platform to the lower platform. In this case, the extending steps preferably comprise first partially extending the lower scissor mechanism, then fully extending the upper scissor mechanism, then fully extending the lower scissor mechanism.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout and in which.

DETAILED DESCRIPTION OF THE PREFERRED EMBODIMENT

1. Resume

Figure 1:
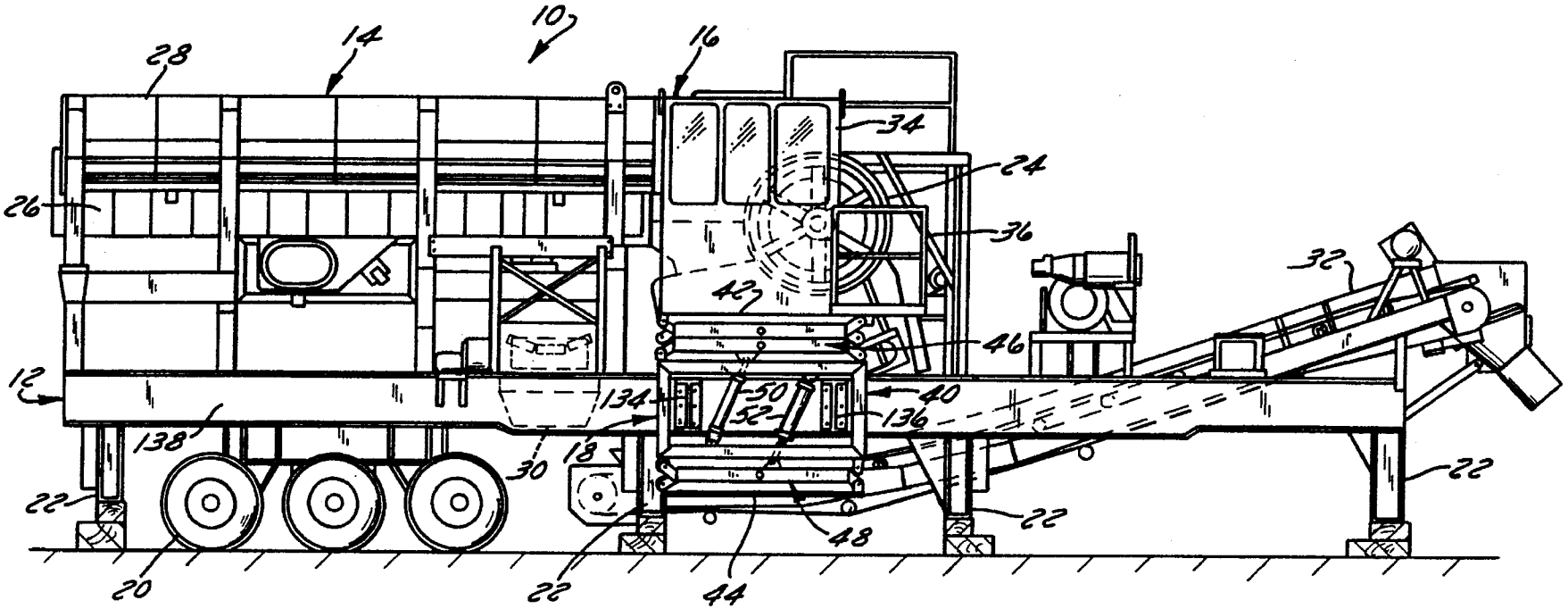
FIG. 1 is a side elevation view of a mineral processing machine having a control cab support mechanism constructed in accordance with the present invention and illustrating the control cab support mechanism in its in pit transport position.
Figure 2:
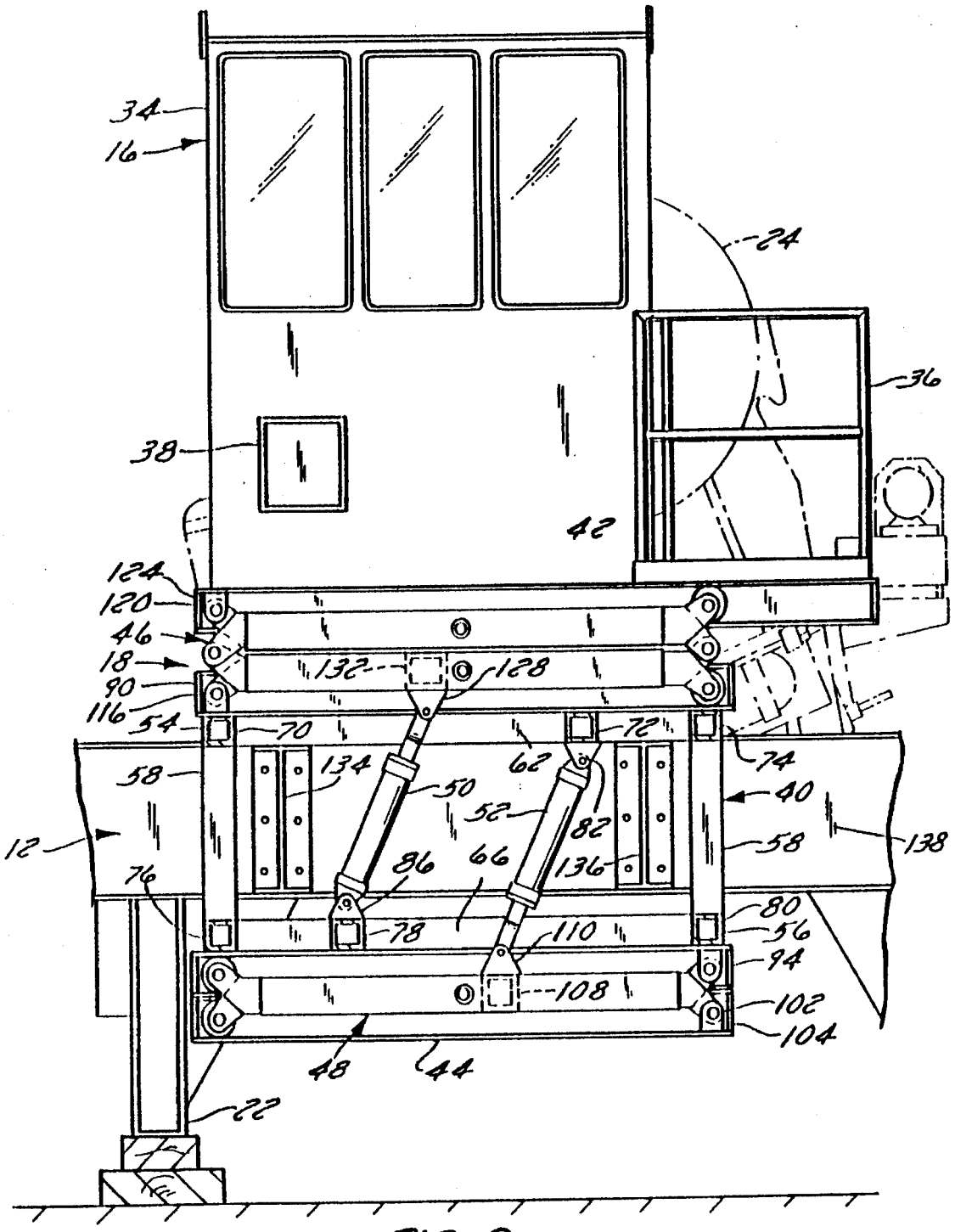
FIG. 2 is an enlarged view corresponding to FIG. 1 and illustrating the control cab, control cab support mechanism, and the surrounding portions of the mineral processing machine with some portions of the mineral processing machine being deleted or illustrated in phantom lines to facilitate illustration.

Pursuant to the invention, a portable mineral processing machine is provided having a chassis, a mineral processing device mounted on the chassis, and a control cab support mechanism operative to raise the control cab vertically from a lowered in pit transport position in which it is supported on the chassis to a raised operative position in which it is supported on the ground and elevated to a designated height above the chassis. The control cab support mechanism preferably takes the form of a scissor lift mechanism including upper and lower scissor mechanisms which are independently operated by respective upper and lower double-acting hydraulic cylinders or the like. The upper scissor mechanism is operative to raise an upper platform with respect to an intermediate support platform, and the lower scissor mechanism is operative to first lower a lower platform with respect to the intermediate support platform, and then to raise the intermediate support platform, upper scissor mechanism, and upper platform with respect to the lower platform. The hydraulic cylinders actuating the upper and lower scissor mechanisms are preferably controlled by a single solenoid actuated manually controlled valve or control unit.

2. System Construction

Referring now to FIGS. 1–8, a portable mineral processing machine 10 is provided having a chassis 12, a mineral processing device 14 mounted on the chassis 12, and a control cab 16 which is movable by operation of a control cab support mechanism 18 from a lowered, in pit transport position in which it is supported on the chassis 12 to a raised, operative position in which it is supported on the ground and elevated to a designated height above the chassis 12.

Chassis 12 is conventional and may take any form so long as it is capable of being transported within a pit or quarry and of supporting the mineral processing devices 14 and the control cab support mechanism 18. The chassis 12 is supported by wheels 20 when in the transport position and by a plurality of movable or extendible supports 22 when in the operative position.

Mineral processing device 14 may comprise any commercially available device used in quarries or the like to crush rock, screen rock, and/or to otherwise grade and/or produce aggregate. The illustrated device comprises a complete aggregate plant manufactured by Telsmith, Inc. of Milwaukee, Wis. and includes as its primary components a jaw crusher 24 and a vibrating feeder 26 located upstream of the crusher 24. As is conventional of such plants, various size rocks or stones are removed from the quarry and are fed into a feed or loading hopper 28 of the vibratory feeder 26. The thus received rocks or stones are graded by the vibrating feeder 26 which discharges smaller (pre-sized) stones to a conveyor 30 and which feeds larger stones to the jaw crusher 24. The jaw crusher 24 receives the larger stones from the vibrating feeder 26, crushes the stones, and feeds the crushed stones to a takeout conveyor 32.

The control cab 16 is designed so as to permit an operator to observe the operation of the machine 10 when the control cab 16 is its operative position and to control the feeder 26, jaw crusher 24, and other plant components as required. To this end, control cab 16 includes 1) an enclosure 34 which normally houses the operator and which contains the controls for the plant 10, and 2) an observation deck 36. A casing 38 is mounted on the side of enclosure 34 and serves as the terminus for hydraulic and/or electric hoses and the like leading from the enclosure 34 to other components of the machine 10.

As discussed above, control cab support mechanism 18 may comprise any device capable of supporting the control cab 16 and of moving the control cab 16 vertically between its lowered in pit transport position to its raised operative position. It is preferred, however, that the control cab support mechanism 18 be dimensioned and configured such that (1) the control cab 16 rests on the chassis 12 when in its in pit transport position so as to facilitate transport of the control cab 16 and of the remainder of the machine 10 as a unit, and such that (2) the control cab 16 is supported on the ground when in its operative position so as to not be subject to vibrations from plant operation. While many control cab support mechanisms could achieve this function, a scissor lift mechanism is preferred because it is relatively simple in construction and operation and yet is very durable and sturdy. The illustrated control cab support mechanism 18 thus comprises a scissor lift mechanism including an intermediate support platform 40 and upper and lower platforms 42 and 44 connected to the support platform 40 by respective upper and lower scissor mechanisms 46 and 48. The upper and lower scissor mechanisms 46 and 48 are actuated by pairs of upper and lower double-acting hydraulic cylinders 50 and 52, respectively.

Figure 3:
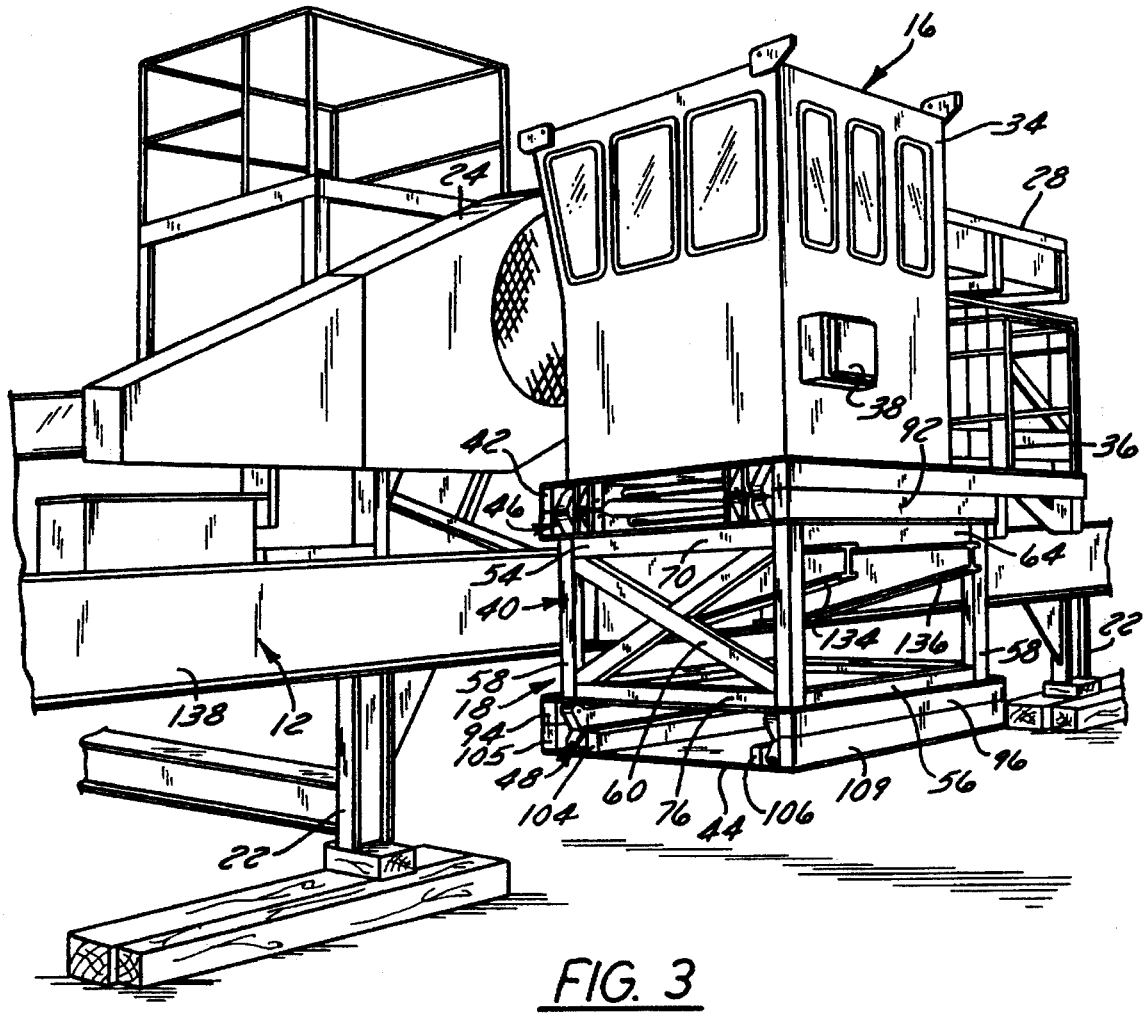
FIG. 3 is a perspective view generally corresponding to FIG. 2.
Figure 4:
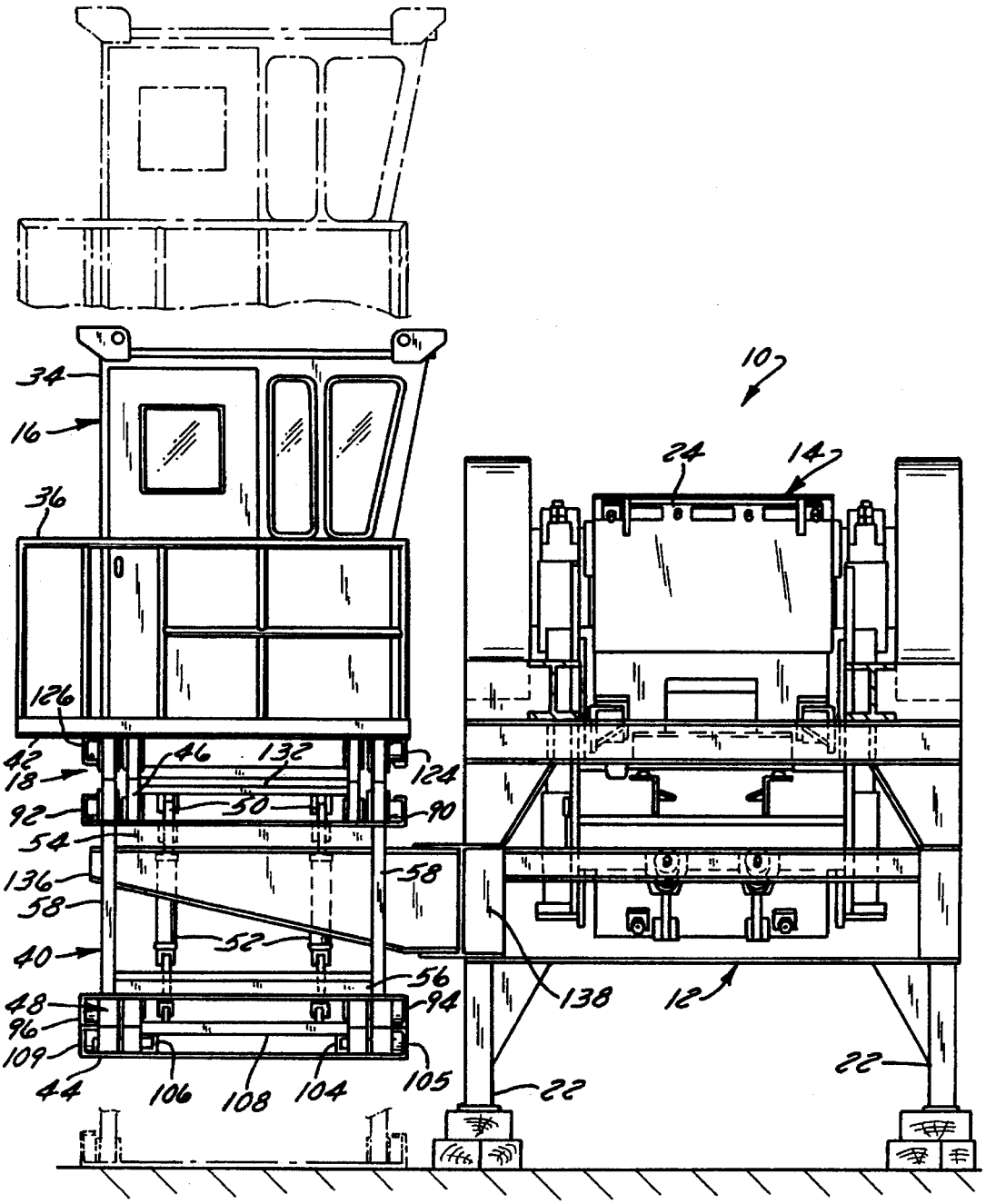
FIG. 4 is an end elevation view of the mineral processing machine of FIG. 1, illustrating the control cab support mechanism in an in pit transport position in solid lines and in an operative position in phantom lines.
Figure 5:
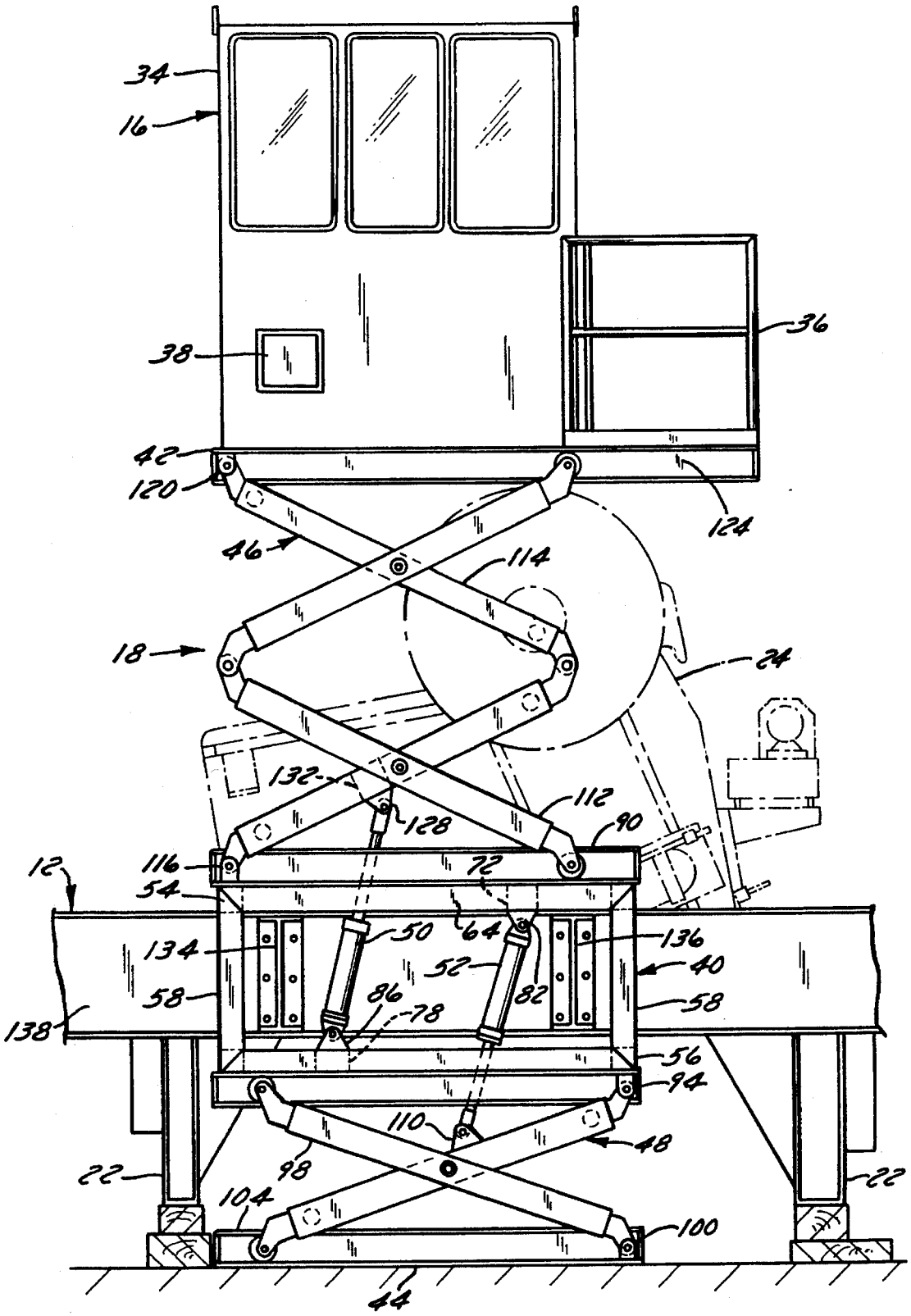
FIG. 5 is a side elevation view corresponding to FIG. 2 but illustrating the control cab support mechanism in an intermediate position.
Figure 7:
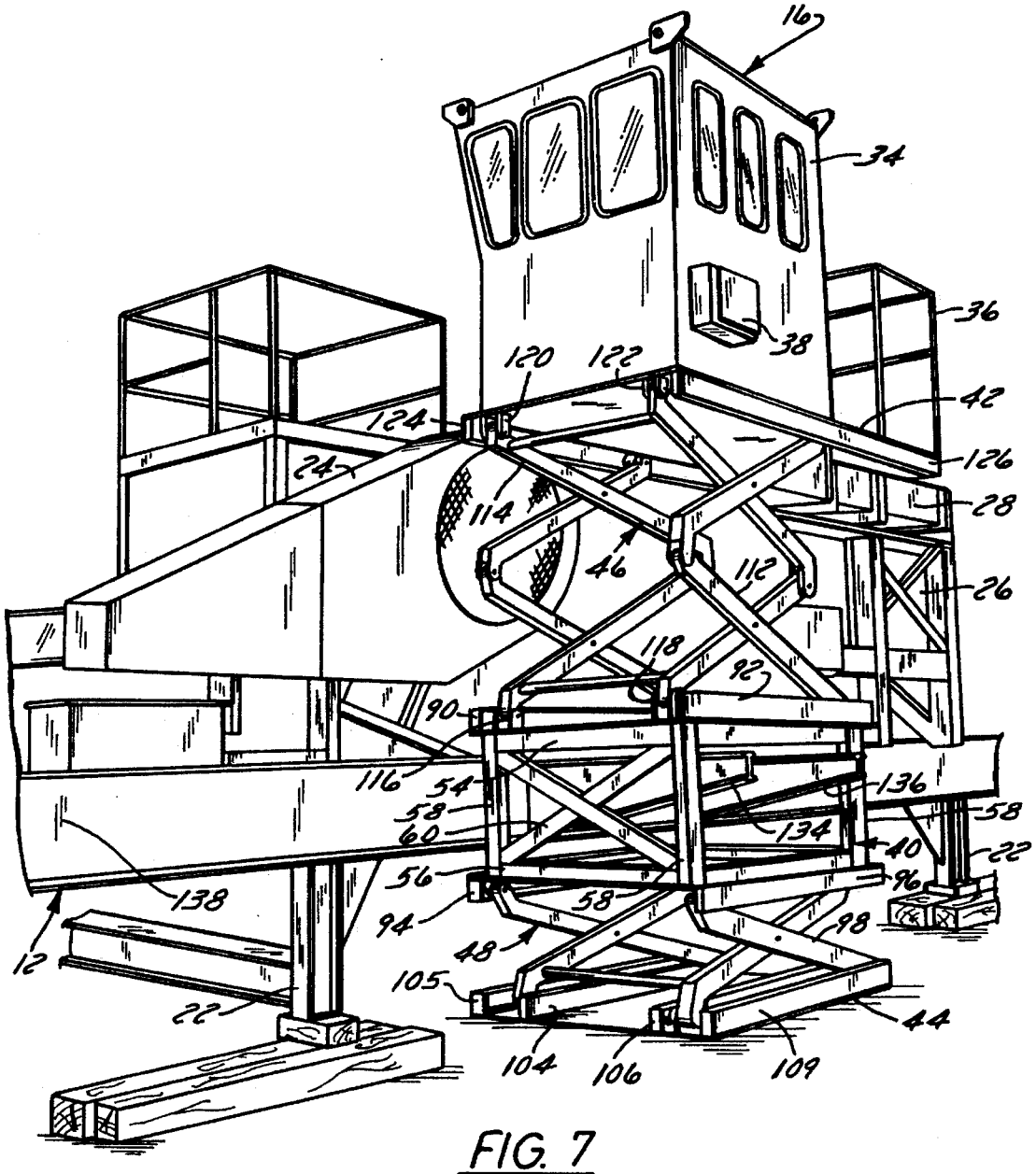
FIG. 7 is a perspective view corresponding to FIG. 3 but illustrating the control cab support mechanism in an operative position.
Figure 8:
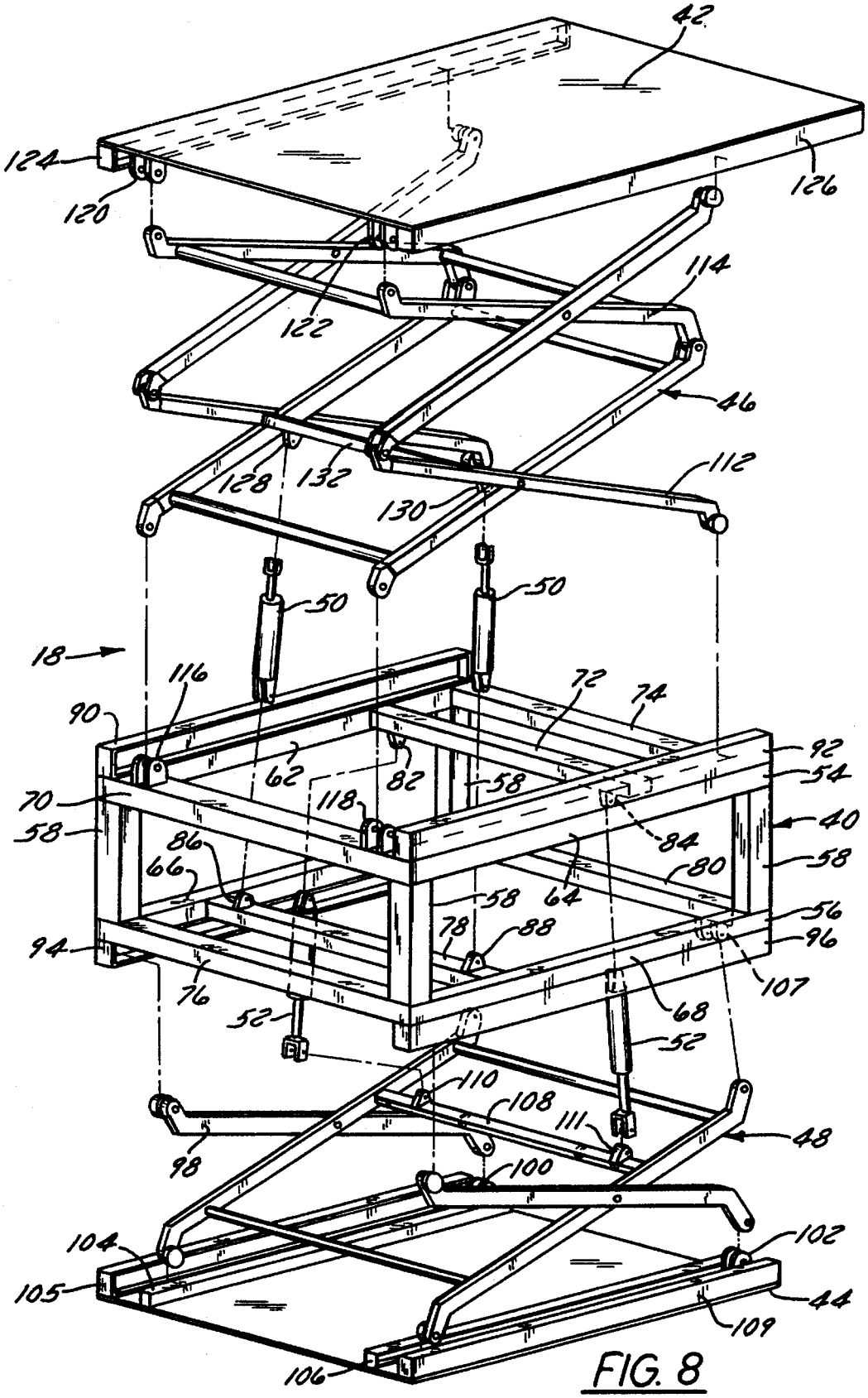
FIG. 8 is an exploded perspective view of the control cab support mechanism of FIGS. 1–7.

The support platform 40 in the illustrated embodiment is constructed from respective upper and lower frames 54 and 56 connected to one another by four vertical struts 58 and opposed diagonal cross braces 60 (seen only in FIGS. 3 and 7). Referring especially to FIG. 8, each of the upper and lower frames 54 and 56 includes opposed respective longitudinal members 62, 64; 66, 68 connected to one another by three respective transverse members 70, 72, 74; 76, 78, 80 the intermediate one 72, 78 of each of which is pivotally connected to the opposite one of the upper and lower cylinders 50 and 52 via respective clevises 82, 84; 86, 88. C-shaped beams 90, 92; 94, 96 are positioned on the outside of the longitudinal members of each frame 54, 56 and present (1) an outer surface for engaging a complementary surface of the respective upper and lower platforms 42 and 44, and (2) an internal channel for receiving rollers of a respective one of the upper and lower scissor mechanisms 46, 48.

Lower scissor mechanism 48 comprises a single scissor arm 98 supported on lower platform 44 at its lower end by pivot pins and rollers engaging clevises 100, 102 and channels formed by longitudinal beams 104, 106, respectively. Additional longitudinal beams 105 and 109 are provided outboard of beams 104 and 106 for contacting the beams 94 and 96 when mechanism 18 is in its in pit transport position. The upper end of scissor arm 98 is similarly supported on the lower frame 56 of the support platform 40 by pivot pins and rollers engaging clevises (only one of which is shown at 107) and channels in members 94, 96, respectively. Scissor arm 98 also presents a transverse brace 108 presenting clevises 110, 111 for receiving the lower, rod ends of the lower cylinders 52.

Upper scissor mechanism 46 requires more extension than the lower scissor mechanism 48 and thus is formed from two scissor arms 112 and 114 connected to one another in series. Upper scissor mechanism 46 is supported at its lower end on the upper frame 54 of the support platform 40 by clevises 116, 118 and channels in the C-shaped members 90, 92. Upper scissor mechanism 46 is further connected at its upper end to the upper platform 42 by corresponding clevises 120, 122 and by corresponding channels in C-shaped beams 124, 126 attached to upper platform 42. Upper scissor mechanism 46 is also pivotally connected to the upper, rod ends of cylinders 50 via clevises 128, 130 mounted on a transverse brace 132 of mechanism 46.

Referring again to FIGS. 1–7, the longitudinal members 62 and 64 of upper frame 54 are designed to rest upon a support assembly of the chassis 12 which in the illustrated embodiment comprises a pair of support arms 134, 136 extending transversely from a longitudinal beam 138 of the chassis 12. The illustrated support arms 134 and 136 take the form of spaced 1-beams each having a length which is slightly greater than the length of the transverse members 70, 72 and 74 of the upper frame 54 of support platform 40. Support arms 134 and 136 also taper from their inner to outer ends for strength. Of course, these support arms could be replaced by any support assembly capable of supporting the control cab support mechanism 18 and control cab 16 on the chassis 12.

3. Description of Hydraulic Circuit

Figure 9:
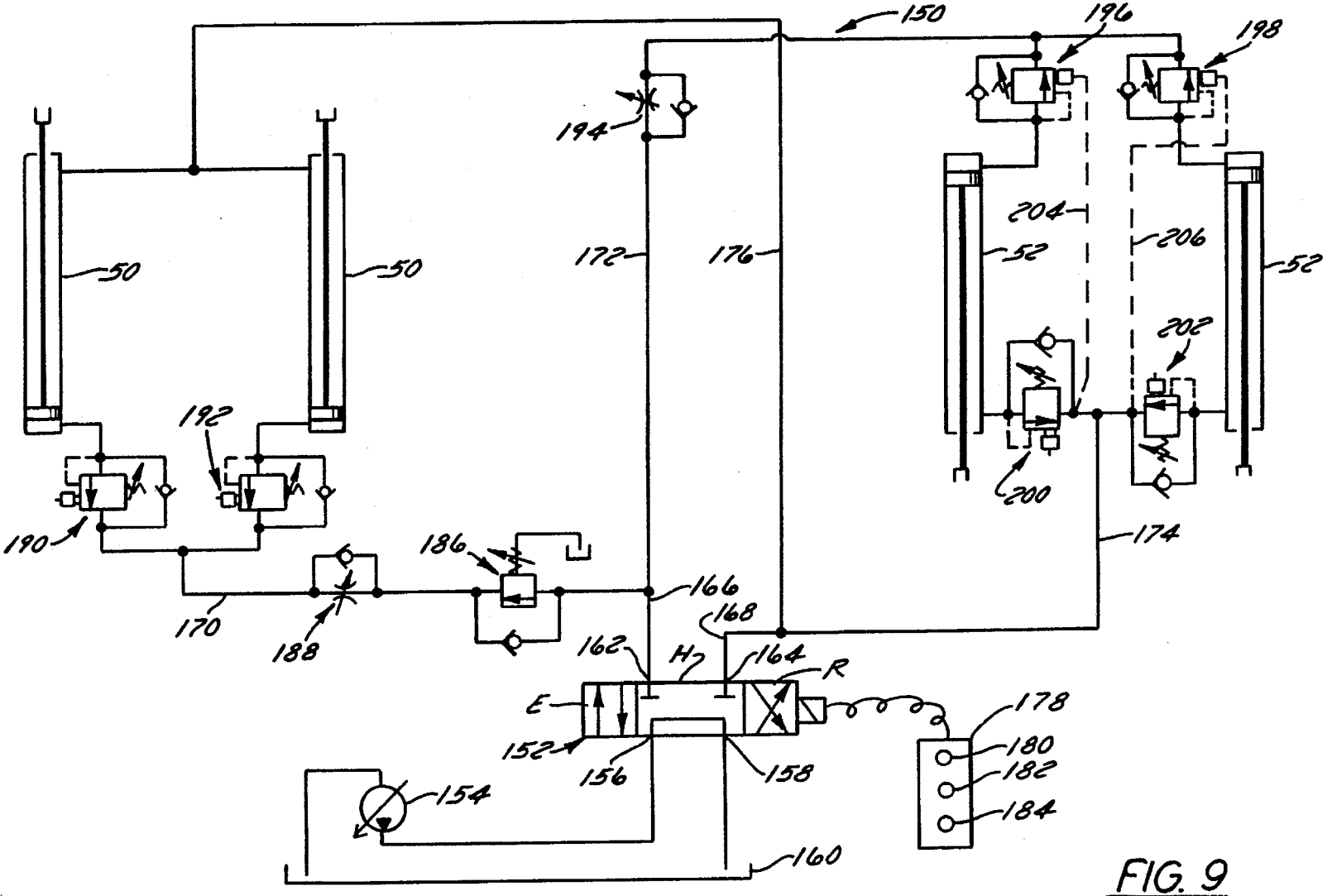
FIG. 9 schematically represents a hydraulic circuit usable to raise and lower the control cab support mechanism of FIGS. 1–8.

Referring now to FIG. 9, a preferred circuit 150 for controlling the operation of the upper and lower double-acting hydraulic cylinders 50 and 52 includes a control valve 152 having an inlet port 156 connected to a pump 154, a return port 158 connected to a reservoir 160, and outlet ports 162, 164 connected to first and second conduits 166, 168. Control valve 152 may take the form of any three-way, four-position valve or its functional equivalent and, in the illustrated embodiment, is a solenoid valve controlled remotely by manual operation of a pendant 178. Pendant 178 has three buttons 180, 182, 184 capable of placing valve 192 in an extend, hold, or release position denoted by E, H, and R, respectively.

Each of the conduits 166 and 168 has first and second branches 170, 172; 174, 176, respectively. The first branch 170 of the first conduit 166 is connected to the cylinder end of each of the upper cylinders 50 and has a sequence valve 186, a flow control 188, and a pair of counterbalance valves 190 and 192 disposed therein. The second branch 172 is connected to the cylinder end of the lower cylinders 52 via a flow control valve 194 and respective counterbalance valves 196 and 198. The first branch 174 of second conduit 168 is connected to the rod ends of lower cylinders 52 via counterbalance valves 200 and 202, and the second branch 176 is connected directly to the rod ends of upper cylinders 50.

Sequence valve 186 is an adjustable pressure regulator permitting free return flow of fluid through branch conduit 170 from the cylinders 50 to the control valve 152 but preventing forward fluid flow toward the cylinders 50 in the absence of sufficient pressure in branch conduit 170 upstream of the sequence valve. Flow control valves 188 and 194 permit free flow of fluid forwardly through branch conduits 170 and 172 but restrict return flow for reasons detailed below. Counterbalance valves 190, 192, 200, and 202 are internally-pilot actuated valves permitting free flow of fluid forwardly through the respective branches 170 and 174 but preventing return flow unless the fluid pressure downstream of the valve exceeds the pressure upstream of the valve by an amount determined by an internal valve spring. Counterbalance valves 196 and 198 are also activated in this manner and are also externally pilot actuated by pilot lines 204 and 206 leading from the branch conduit 174. All of these valves are commercially available and thus will not be described in further detail.

4. Operation of Control Cab Support Mechanism

Referring now to FIGS. 1–9, the mineral processing machine 10 (constituting an aggregate plant in the illustrated embodiment) is transported to a worksite such as a quarry with the supports 22 removed or retracted such that the chassis 12 is supported only on the wheels 20. The illustrated support arms 134 and 136 are then installed and securely fastened to the chassis 12. The control cab support mechanism 18, complete with intermediate support platform 40, upper and lower platforms 42 and 44, upper and lower scissor mechanisms 46 and 48, upper and lower cylinders 50, 52, the hydraulic pump 154, control valve 162, and control pendant 178 is then placed on the support arms 134, 136. Once the machine 10 is properly located at the worksite, the supports 22 are extended or attached such that the chassis 12 is firmly supported on the ground as illustrated in FIG. 1. The control cab support mechanism 18 is still in its in pit transport position at this time with the upper and lower cylinders 50 and 52 and associated scissor mechanisms 46 and 48 fully retracted so that (1) the upper platform 42 supporting the control cab 16 rests on the support platform 40, (2) the support platform 40 in turn rests on the support arms 134 and 136 extending from the longitudinal beam 138 of chassis 12, and (3) the lower platform 44 is lifted off from the ground to a position in which beams 105, 109 on lower platform 44 engage the mating beams 94, 96 on the lower frame 56 of support platform 40.

The control cab 16 is then lifted into its operative position by activating the pendant 178 for the three-position, four-way solenoid valve 152 to place the valve in its extend (E) position. Hydraulic fluid is thus supplied to the cylinder ends of the lower cylinders 52 via conduit branch 172 of conduit 166 and flow control valve 194 and counterbalance valves 196, 198 positioned therein, and the cylinders 52 are extended to lower the lower platform 44 towards the ground. Fluid flow into upper cylinders 50 is prevented at this time by sequence valve 186, which is set at a pressure higher than that required to initially extend the lower cylinders 52. It should be noted that initial extension of the cylinders 52 increases the pressure in the conduits leading from the counterbalance valves 200 and 202 to the rod ends of the cylinders 52 sufficiently to open valves 200 and 202 and permit fluid previously trapped in the cylinders to flow into the reservoir through the conduit 168 and valve 152. The operator will be advised of ground engagement by the lower platform 44 through a discernible change in pitch of the now laboring pump or motor 154 and will then release the extend switch 180 on the pendant 178 to place the valve 152 in its hold (H) position in which no additional fluid is supplied to conduit 172. Retraction of the lower cylinders 52 is prevented at this time by counterbalance valves 196 and 198 which close in the absence of a positive pressure differential across the valves.

Figure 6:
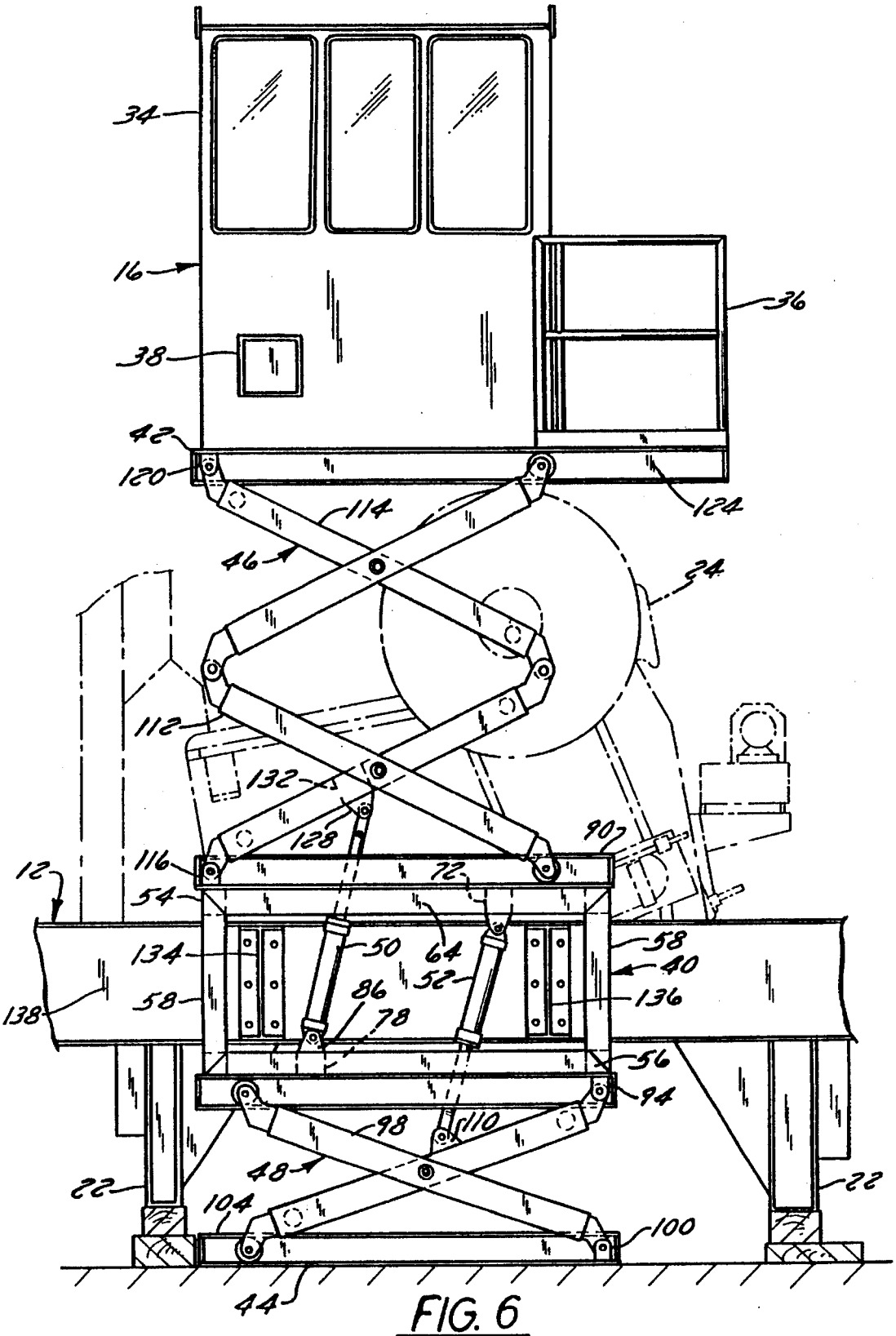
FIG. 6 is a side elevation view corresponding to FIG. 2 but illustrating the control cab support mechanism in an operative position.

Next, the control cab 16 and control cab support mechanism 18 are placed in an intermediate position illustrated in FIG. 7 through further activation of the extend switch 180 on the pendant 178 for the control valve 152. Specifically, activation of switch 180 again places valve 152 in the state (E) supplying pressurized fluid to branch conduit 170. However, since considerable force is required to raise the entire control cab support mechanism, the pressure in branch conduit 170 increases sufficiently to open sequence valve 186. Fluid thus flows at a pressure determined by sequence valve 186 into the cylinder ends of the upper cylinders 50 through the control valve 152, sequence valve 186, flow control valve 188, and counterbalance valves 190, 192. Upper cylinders 50 and upper scissor mechanism 46 thus extend to raise the upper platform 42 and control cab 16 with respect to the support platform 40. When the upper cylinders 50 are fully extended, further fluid supplied to conduit 166 will flow into branch conduit 172 and cause further extension of the lower cylinders 52, thus lifting the support platform 40 about one to two inches from the support arms 134 and 136 as illustrated in FIGS. 6 and 7 upon full extension of lower cylinders 52. The control cab 16 is now placed in its operative position in which it is (1) positioned at a designated height above the chassis 12 permitting ready observation of aggregate plant operation, and (2) supported on the ground rather than on the chassis 12 and is thus isolated from vibrations in the plant 10. This promotes operator comfort and reduces wear and tear on the controls in the control cab 16.

To lower the control cab 16 for in pit transport, i.e., transport between worksites in the quarry, the retract switch 184 on pendant 178 is activated to place the control valve 152 in the state R in which pressurized fluid is supplied to the rod ends of the upper and lower cylinders 50 and 52 to retract the cylinders and the corresponding scissor mechanisms 46, 48. The support platform 40 will first settle back down onto the support arms 134 and 136 under retraction of the lower cylinders 52 and lower scissor mechanism 48, and the upper scissor mechanism 46 will then continue to retract to lower the upper platform 42 and the control cab 16 until the upper platform 42 rests on the support platform 40. Relatively gradual setting of the upper scissor mechanism 46 is assured by operation of fluid flow control valve 188, which restricts return fluid flow through conduit 170. Continuing to hold the retract switch 184 will then raise the lower platform 44 up off the ground upon further retraction of the lower cylinders 52 to again place the machine or plant 10 in the position illustrated in FIGS. 1–3. During this operation, fluid flows from the cylinder ends of lower cylinders 52 to the reservoir 160 through counterbalance valves 196 and 198, which are opened under the presence of pilot pressure in lines 204 and 206 due to pressurization of the second circuit 174.

Bleed-off of fluid from the retracted lower cylinders 52 after the retract button 184 is released is prevented through closure of the counterbalance valves 200 and 202, thus assuring that the lower cylinders 52 will remain in their fully retracted positions and that the lower platform 44 will be kept from the ground during in pit transport.

Many changes and modifications may be made to the device disclosed and described above without departing from the spirit of the present invention. The scope of such changes will become apparent from the appended claims.

I claim:

1. An apparatus comprising:

(A) a mineral processing machine having a portable chassis; and (B) a control cab assembly for housing an operator for said mineral processing machine, said control cab assembly including (1) a control cab; and (2) a control cab support mechanism on which said control cab is mounted, said control cab support mechanism being actuatable to move said control cab vertically and linearly from a first position in which said control cab is supported only on said chassis to a second position in which said control cab is lifted from said chassis and supported only on the ground.

2. An apparatus as defined in claim 1, wherein said control cab is at a first designated height when in said first position and at a second designated height when in said second position, said second designated height being higher than said first designated height.

3. An apparatus as defined in claim 1, wherein said control cab support mechanism comprises (1) an upper platform on which said control cab is mounted; and (2) a lower platform on which said upper platform is supported, said upper platform being movable vertically and linearly relative to said lower platform.

4. An apparatus as defined in claim 3, wherein (1) said control cab support mechanism further comprises a support platform which is positioned between and coupled to said upper and lower platforms, (2) said upper platform is movable vertically and linearly relative to said support platform, and (3) said support platform is movable vertically and linearly relative to said lower platform.

5. An apparatus as defined in claim 1, further comprising a support arm assembly attached to and extending transversely away from said chassis, wherein said control cab is 1) supported on said support arm assembly when said control cab is in said first position and 2) positioned directly above and spaced vertically from said support arm assembly when said control cab is in said second position.

6. An apparatus comprising:

(A) a mineral processing machine having a portable chassis; and (B) a control cab assembly for housing an operator, said control cab assembly including (1) a control cab; and (2) a control cab support mechanism on which said control cab is mounted, said control cab support mechanism being actuatable to raise said control cab from a first position in which said control cab is supported on said chassis to a second position in which said control cab is lifted from said chassis and supported on the ground, wherein said control cab support mechanism includes a. an upper platform on which is mounted said control cab;

b. a lower platform for engaging the ground;

c. a support platform which is positioned between said upper and lower platforms and which rests on said chassis when said control cab is in said first position;

d. an upper scissor mechanism connecting said upper platform to said support platform; and e. a lower scissor mechanism connecting said lower platform to said support platform.

7. An apparatus as defined in claim 6, wherein said control cab support mechanism further comprises an upper cylinder connecting said support platform to said upper scissor mechanism and a lower cylinder connecting said support platform to said lower scissor mechanism.

8. An apparatus as defined in claim 7, wherein said support platform comprises (A) an upper frame to which said lower cylinder is attached and which rests on said chassis when said control cab is in said first position;

(B) a lower frame to which said upper cylinder is attached; and (C) struts connecting said upper frame to said lower frame.

9. A mineral processing machine comprising:

(A) a portable chassis;

(B) a mineral processing device mounted on said chassis;

(C) a control cab; and (D) means for moving said control cab vertically and linearly from an in pit transport position in which said control cab is supported only on said chassis to an operative position in which said control cab is (1) lifted from said chassis and (2) supported only on the ground.

10. An apparatus as defined in claim 9, wherein said mineral processing device comprises a rock crusher.

11. An apparatus comprising:

(A) a portable chassis;

(B) a mineral processing device mounted on said chassis;

(C) a control cab;

(D) means for lifting said control cab from an in pit transport position in which said control cab is supported on said chassis to an operative position in which said control cab is (1) lifted from said chassis and (2) supported on the ground; and (E) a pair of support arms attached to and extending transversely away from said chassis and forming a support assembly for said control cab when said control cab is in said in pit transport position.

12. An apparatus as defined in claim 11, wherein said means for lifting comprises a scissor lift mechanism which includes (A) an upper platform on which said control cab is mounted;

(B) a lower platform for engaging the ground;

(C) a support platform which is positioned between said upper and lower platforms and which rests on said support arms when said control cab is in said in pit transport position;

(D) an upper scissor mechanism connecting said upper platform to said support platform; and (E) a lower scissor mechanism connecting said lower platform to said support platform.

13. An apparatus as defined in claim 12, wherein said scissor lift mechanism further comprises an upper cylinder connecting said support platform to said upper scissor mechanism and a lower cylinder connecting said support platform to said lower scissor mechanism.

14. An apparatus as defined in claim 13, wherein said support platform comprises (A) an upper frame to which said lower cylinder is attached and which rests on said support arms when said control cab is in said in pit transport position;

(B) a lower frame to which said upper cylinder is attached; and (C) struts connecting said upper frame to said lower frame.

15. An apparatus as defined in claim 13, further comprising means for (A) partially extending said lower cylinder; then (B) fully extending said upper cylinder; and then (C) fully extending said lower cylinder.

16. An apparatus as defined in claim 12, wherein said upper scissor mechanism comprises first and second scissor arms pivotally connected to one another in series.

17. An apparatus comprising:

(A) a mineral processing machine having a portable chassis; and (B) a control cab assembly for housing an operator for said mineral processing machine, said control cab assembly including (1) a control cab; and (2) a control cab support mechanism on which said control cab is mounted, said control cab support mechanism being actuatable to move said control cab vertically from a first position in which said control cab is supported on said chassis to a second position in which said control cab is lifted from said chassis and supported on the ground at a location beneath said chassis, wherein said control cab is at a first designated height when in said first position and at a second designated height when in said second position, said second designated height being higher than said first designated height.

18. An apparatus as defined in claim 17, wherein said control cab support mechanism moves said control cab vertically and linearly with respect to said chassis.

19. An apparatus as defined in claim 17, wherein said control cab support mechanism comprises (1) an upper platform on which said control cab is mounted; and (2) a lower platform on which said upper platform is supported, said upper platform being movable vertically and linearly relative to said lower platform.

20. An apparatus as defined in claim 19, wherein (1) said control cab support mechanism further comprises a support platform which is positioned between and coupled to said upper and lower platforms, (2) said upper platform is movable vertically and linearly relative to said support platform, and (3) said support platform is movable vertically and linearly relative to said lower platform.

21. An apparatus comprising:

(A) a portable chassis;

(B) a mineral processing device mounted on said chassis;

(C) a support assembly mounted on said chassis;

(D) a control cab; and (E) a scissor lift mechanism on which said control cab is mounted, said scissor lift mechanism being movable from a first position in which said control cab is supported on said support assembly to a second position in which said control cab is lifted to a designated height above said support assembly and supported on the ground, said scissor lift mechanism including (1) an upper platform on which is mounted said control cab;

(2) a lower platform for engaging the ground;

(3) a support platform which is positioned between said upper and lower platforms and which rests on said support assembly when said scissor lift mechanism is in said first position;

(4) an upper scissor mechanism connecting said upper platform to said support platform; and (5) a lower scissor mechanism connecting said lower platform to said support platform.

* * * * *